United States Patent [19]

Kobayashi

[11] 4,368,096

[45] Jan. 11, 1983

[54] PHOTOGRAPHIC FILM SPLICER

[75] Inventor: Kazuhiko Kobayashi, Minami-ashigara, Japan

[73] Assignee: Fuji Photo Film Co., Ltd., Kanagawa, Japan

[21] Appl. No.: 296,022

[22] Filed: Aug. 25, 1981

[30] Foreign Application Priority Data

Aug. 29, 1980 [JP] Japan ..... 55-119207

[51] Int. Cl.[3] ..... B65H 21/02

[52] U.S. Cl. ..... 156/502; 156/159; 156/304.1; 156/505; 156/506; 156/507; 156/544; 156/545

[58] Field of Search ..... 156/159, 304.1, 502, 156/505, 506, 507, 544, 545

[56] References Cited

U.S. PATENT DOCUMENTS 3,567,555 3/1971 Stenzenberger et al. ..... 156/502
4,279,685 7/1981 Barnett et al. ..... 156/509

FOREIGN PATENT DOCUMENTS 154748 10/1938 Austria ..... 502/
2646458 4/1978 Fed. Rep. of Germany ..... 156/502

*Primary Examiner*—Caleb Weston
*Attorney, Agent, or Firm*—Sughrue, Mion, Zinn, Macpeak & Seas

[57] ABSTRACT

A film splicer includes first and second parallel film handling stations with a first cutter in the first film handling station cutting the leading edge of a succeeding film strip. A pair of pins engage either film strip perforations or one longitudinal edge of the succeeding film strip and shift the film transversely into the second film handling station. The first cutter in the first film handling station cuts the front edge of the film such that it will be substantially in its proper position for splicing once it is transversely shifted to the second film handling station. A lever in the second film handling station is provided for automatically actuating a rear edge cutter in the second film handling station as soon as the film has been entirely removed from its spool.

7 Claims, 3 Drawing Figures

PHOTOGRAPHIC FILM SPLICER

BACKGROUND OF THE INVENTION

This invention relates to a photographic film splicer which splices photographic films withdrawn from cartridges to form an elongated web of photographic film.

In order to obtain an elongated web of exposed photographic film for developing it, it is known to cut the front and rear edges of films withdrawn from cartridges, and splice the rear edge of a preceding film to the front edge of a succeeding film with a splicing tape. This method involves two steps of cutting and a single step of splicing for each film. The elongated web thus obtained is transported progressively, or wound on a reel or the like.

According to the apparatus known in the art, the front edge of a film is cut and spliced to the rear edge of a preceding film, and after a spliced web has been moved aside, its rear edge is cut. Likewise, a second set of films are cut, and spliced together to form a second web. Therefore, there is a time lag between the cutting of the rear edge of a first web and the cutting of the front edge of a second web. This time lag depends on the skill of the operator, and brings about a reduction in the stability and efficiency of the splicing operation.

SUMMARY OF THE INVENTION

In view of the aforesaid drawbacks of the prior art, it is an object of this invention to provide a highly effective photographic film splicer which enables the splicing operation to be performed in a shortened time without depending appreciably on the skill of the operator.

According to this invention, the aforesaid object is attained by the provision of a first film handling station and a second film handling station which extend in a single plane in parallel to each other longitudinally of the films to be spliced. The first film handling station includes means for cutting the front edge of a film, while the second film handling station includes means for cutting the rear edge of a film, and means for splicing films together. Means are provided for moving a film transversely from the first film handling station to the second film handling station, so that the splicing operation can be continued substantially without any interruption. A second or succeeding film has its front edge cut in the first film handling station before the rear edge of a first film is cut in the second film handling station, and after the first film has been started in the second film handling station, the second film is transferred transversely from the first film handling station to the second film handling station. The front edge of the second film is so positioned relative to the rear edge of the first film that they can be spliced to each other promptly in the second film handling station. When the second film has been positioned in the second film handling station, the first film handling station is ready to receive a third film and cut its front edge.

BRIEF DESCRIPTION OF THE DRAWINGS

The invention will now be described by way of example with reference to the drawings, in which.

DETAILED DESCRIPTION OF THE PREFERRED EMBODIMENTS

Figure 1:
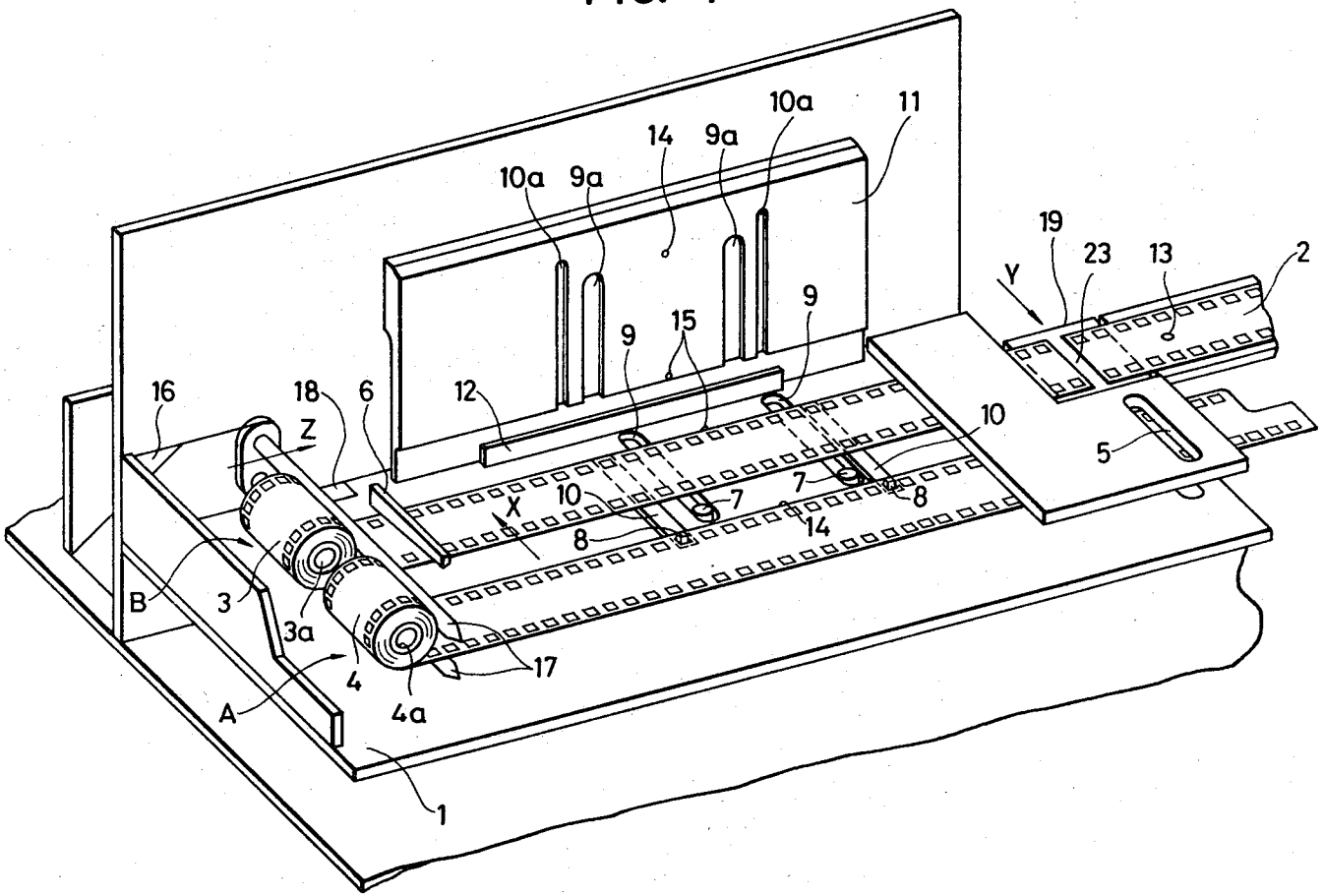
FIG. 1 is a perspective view of a photographic film splicer according to the present invention.

Referring first to FIG. 1 of the drawings, there is shown in perspective a photographic film splicer embodying this invention. The splicer includes a first film handling station A provided on a table 1, and having a cutter 5 for cutting the front edge of a film 4. The table 1 also provides a second film handling station B which extends in parallel to the first film handling station A and includes a cutter 6 for cutting the film at its rear edge, and a film splicing device 19. A film 2, which has had its front and rear edges cut, and moved outwardly of the second film handling station B, has its rear edge aligned in position on the splicing device 19 by a device 13 which detects the rear edge and controls its position. Numeral 3 designates a film which has been transferred transversely from the first film handling station A to the second film handling station B by the transversely moving means, which will hereinafter be described in further detail. A film 4 in the first film handling station A has its front edge cut by the cutter 5. The cutter 5 is situated in alignment with a gap 23 to be formed between the film edges to be spliced, so that the film having its front edge cut in the first film handling station A may be spliced to the preceding film in the second film handling station B without requiring any positional adjustment when the front edge of the of the succeeding film has been transversely transferred onto the splicing device 19. A splicing tape not shown is fed in the direction of an arrow Y in FIG. 1, and downwardly toward the splicing device 19 to splice the films 2 and 3.

The means for moving a film transversely comprises a pair of engaging pins 8 each of which is movable in a first slot 10 formed in the table 1 transversely of the films to be spliced, and a pair of film guide pins 7 each of which is movable in a second slot 9 formed in the table 1 in parallel to the first slots 10. Each of the engaging pins 8 is engageable with one of perforations provided in a film along a longitudinal edge thereof, while the film guide pins 7 control the position of the longitudinal edge of the film when it is moved transversely. The film having its front edge cut in the first film handling station A, and its longitudinal edge engaged by the engaging pins 8, is transferred transversely onto the second film handling station B when the engaging pins 8 and the film guide pins 7 move in the direction of an arrow X in FIG. 1. A film detector 15 is provided for detecting the film which has been transferred to the second film handling station B.

Then, the engaging pins 8 and the film guide pins 7 are lowered from the film in the second film handling station B to their lower position below the upper surface of the table 1, and moved backward below the film in a direction opposite to that of the arrow X, and raised to their upper position to engage another film in the first film handling station A. A film edge detector 14 is provided for detecting a longitudinal edge of the film fed to the first film handling station A to ascertain that the film is in its right position on the station A. The cutter 5 is lowered by a solenoid, or other driving means not shown to cut the front edge of the film. The cutter 5 is so positioned that it can cut the film substantially in the middle between adjoining perforations when the engaging pins 8 are engaged with the film. The high stability of film splicing and transportation is ensured, since it is never cut through any of its perforations.

Figure 2:
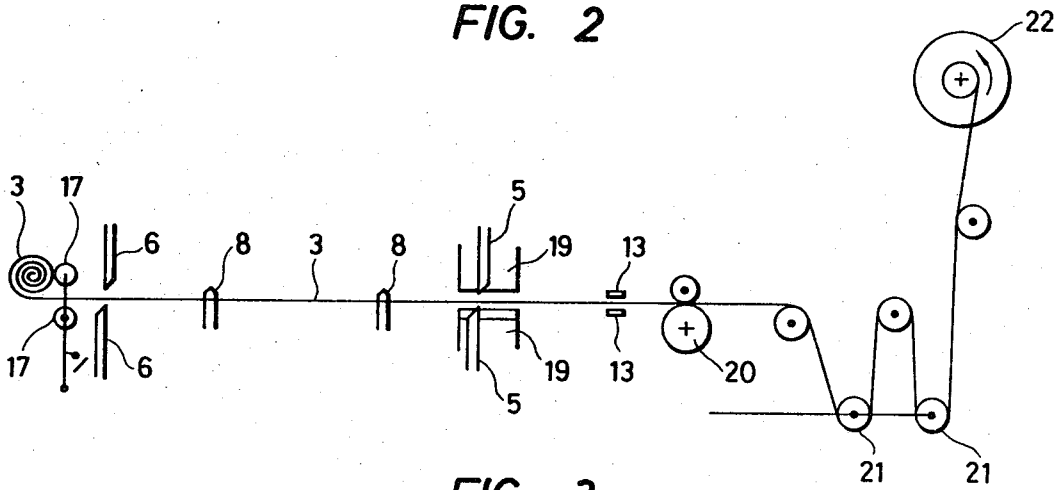
FIG. 2 is a diagrammatic side elevational view of the apparatus shown in FIG. 1.

When a film is being positioned in the first film handling station A, the film in the second film handling station B has its front edge joined to the rear edge of a preceding film. The elongated web of film thus obtained is wound on a reel as shown in FIG. 2. The apparatus further includes a pair of guide bars 17 along which the film 3 has been transversely moved from the first film handling station A to the second film handling station B, and the film 4 is likewise moved transversely when the preceding film 3 has left the second film handling station B. The films 3 and 4 shown in FIG. 1 have their rear edges fastened to spools 3*a* and 4*a*, respectively, removed from cylindrical metal casings defining cartridges. If desired, however, it is possible to feed the apparatus with films without removing their cartridges. When the film 3 has been fully unwound from its spool 3*a*, it pulls the guide bars 17 and slides them in a slot 18 in the direction of an arrow Z in FIG. 1, i.e., the direction in which the film has been unwound. The sliding motion of the guide bars 17 actuates a solenoid not shown to cause the cutter 6 to cut the rear edge of the film 3. After its rear edge has been cut, the film continues to be wound past the rear edge detector 13 until its rear edge is placed in position on the splicing device 19, and the film 3 takes the position which is now occupied by the film 2 in FIG. 1. Simultaneously, the spool 3*a* is ejected through a discharge opening 16, and the film 4 is transferred from the first film handling station A to the second film handling station B.

The apparatus of FIG. 1 further includes a cover 11 rotatably connected to the table 1 by a pivotal member 12, and covering the films on the table 1 during the splicing operation. The cover 11 has an inner surface provided with slots 9*a* and 10*a* which permit the movement of the film guide pins 7 and the engaging pins 8 in the direction of the arrow X even if the cover 11 is closed.

FIG. 2 is a diagrammatic side elevational view of the apparatus shown in FIG. 1. The elongated web formed by the films spliced on the joining device 19 as hereinabove described is drawn past a feed roller 20 and dancer rollers 21, and wound on the reel 22. In FIG. 2, the signs "+" at the axes of some rollers indicate that they are driving rollers.

Figure 3:
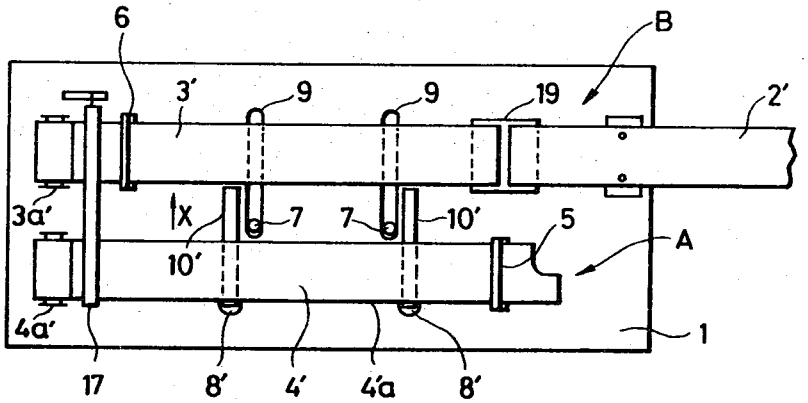
FIG. 3 is a schematic top plan view of a photographic film splicer according to a second embodiment of the present invention.

Attention is now directed to FIG. 3 which is a schematic top plan view of a photographic film splicer according to another embodiment of this invention. This apparatus is particularly useful in the splicing of rolled film having no perforation along its longitudinal edges, for example, a leader. It comprises modified film engaging pins 8', and slots 10' in which the pins 8' are movable. The engaging pins 8' are engageable with the opposite longitudinal edge 4*a'* of a film 4' in the first film handling station A from the second film handling station B to pull the film in the direction of the arrow X. The slots 10', therefore, extend across the first film handling station A. Thus, the apparatus of FIG. 3 is as useful in the splicing of film having no perforation along its longitudinal edges as that of FIG. 1 is in the splicing of film having a perforated longitudinal edge.

As hereinabove described in detail, the apparatus of this invention essentially comprises a first film handling station including a cutter for cutting the front edge of a film, a second film handling station including a cutter for cutting the rear edge of a film and means for splicing films, and means for moving a film transversely from the first film handling station to the second film handling station. Therefore, the apparatus makes it possible to accomplish the cutting and/or splicing of three films in a single cycle of operation, and ensures the improved efficiency of the splicing operation.

What is claimed is:

1. A photographic film splicer for splicing the rear edge of a preceding film with the front edge of a succeeding film, each of said films being in the form of a roll having its rear edge fastened to a respective spool, and each of said films having its front and rear edges cut when removed from said respective spool, the improvement comprising:

a first film handling station including cutting means for cutting the front edge of said succeeding film while said succeeding film extends from its respective spool in a first direction;

a second film handling station positioned in parallel to said first film handling station and including second cutting means for cutting the rear edge of said preceding film, and further including splicing means for splicing said preceding and succeeding films; and transverse film shifting means for moving said succeeding film transversely of said first direction from said first film handling station to said second film handling station.

2. A photographic film splicer as defined in claim 1, wherein said transverse film shifting means comprises at least two engaging pins each of which is movable between said first and second film handling stations, said pins engaging said succeeding film in said first film handling station, moving in a direction transverse to said first direction to thereby move said succeeding film to said second film handling station, disengaging said succeeding film and returning to said first film handling station.

3. A photographic film splicer as defined in claim 2, wherein said succeeding film includes a plurality of perforations provided in a longitudinal edge thereof, said at least two engaging pins each engaging a different one of said perforations in said succeeding film.

4. A photographic film splicer as defined in claim 2, wherein said succeeding film in said first film handling station includes an opposite longitudinal edge positioned furthest from said second film handling station, said at least two engaging pins engaging said opposite longitudinal edge of said succeeding film in said first film handling station and moving in a direction transverse to said first direction to thereby move said succeeding film to said second film handling station.

5. A photographic film splicer as defined in claim 1, wherein said splicing means splices said rear edge of said preceding film and said front edge of said succeeding film with said front edge in a predetermined position in said second film handling station, and wherein said first cutting means in said first film handling station cuts the front edge of said succeeding film at a first cutting position which is substantially in horizontal alignment with the predetermined position of said front edge in said splicing means, whereby said front edge of said succeeding film will be substantially at its predetermined position after transverse movement to said second film handling station by said transverse film shifting means.

6. A photographic film splicer as defined in claim 1, the improvement further comprising lever means adjacent the film in said second film handling station and between said splicing means and the spool to which said film in said second film handling station is fastened, said lever means being shiftable along said first direction when said film in said second film handling station is substantially completely removed from said spool, the shifting of said lever means actuating said second cutting means.

7. A photographic film splicer as defined in any one of claims 2–4, wherein said engaging pins are slidable transversely between said first and second film handling stations in respective slots beneath said films, said pins protruding from said slots to engage said succeeding film and retracting into said slots for disengaging said succeeding film.

* * * * *